US007192621B2

(12) United States Patent
Motegi

(10) Patent No.: US 7,192,621 B2
(45) Date of Patent: Mar. 20, 2007

(54) KEYPAD AND METHOD OF SEPARATING A CROSSLINKED CURED RESIN LAYER THEREOF

(75) Inventor: Seiko Motegi, Kita-ku (JP)

(73) Assignee: Polymatech Co., Ltd., Tokyo (JP)

( * ) Notice: Subject to any disclaimer, the term of this patent is extended or adjusted under 35 U.S.C. 154(b) by 559 days.

(21) Appl. No.: 10/317,237

(22) Filed: Dec. 10, 2002

(65) Prior Publication Data

US 2003/0107554 A1 Jun. 12, 2003

(30) Foreign Application Priority Data

Dec. 11, 2001 (JP) ..... 2001-377841

(51) Int. Cl.
*B05D 3/10* (2006.01)
*B05D 5/00* (2006.01)

(52) U.S. Cl. ..... 427/155; 427/154; 427/258; 427/336; 427/407.1; 427/412.1

(58) Field of Classification Search ..... 427/154–155, 427/336, 407.1, 410, 412.1, 258
See application file for complete search history.

(56) References Cited

U.S. PATENT DOCUMENTS 4,612,058 A * 9/1986 Geke et al. ..... 134/38
5,342,854 A 8/1994 Serad
5,912,083 A 6/1999 Jimu et al. ..... 428/448
2002/0186947 A1* 12/2002 Abe et al. ..... 385/128
2003/0015613 A1* 1/2003 Yamamoto ..... 241/260.1
2004/0197479 A1* 10/2004 Yoshie ..... 427/336

FOREIGN PATENT DOCUMENTS

| | | |
|---|---|---|
| DE | 19940386 A1 | 4/2001 |
| JP | 16-314527 | 8/1994 |
| JP | 11312431 | 9/1999 |
| JP | 2000106055 | 11/2000 |

* cited by examiner

*Primary Examiner*—Kirsten Jolley
(74) *Attorney, Agent, or Firm*—Fish & Neave IP Group Ropes & Gray LLP; Gall C. Gotfried

(57) ABSTRACT

The present invention related a keypad (1) in which a keypad main body (4) composed of a thermoplastic elastomer has formed thereon a cross-linked cured resin layer (5) of a cross-linked cured resin that is separable from the keypad main body (4) by swelling with a predetermined solvent, or a method of separating the keypad main body (4) and the cross-linked cured resin layer (5). The keypad main body (4) is made of a thermoplastic elastomer and has the cross-linkage curing resin layer (5) placed thereon, which eliminates defects of a display layer (6) placed on the thermoplastic elastomer surface exhibiting low abrasion resistant properties and the display layer readily disappearing and which not only renders the display layer (6) to hardly disappear even if a key is repeatedly used, but also allows the cross-linked cured resin layer (5) to readily separate from the keypad main body (4) when the resin layer (5) is swelled with a solvent, thereby making it possible to individually and readily recycle the cross-linked cured resin layer (5) and the keypad main body (4) and to obtain a recycled article of high quality.

9 Claims, 2 Drawing Sheets

KEYPAD AND METHOD OF SEPARATING A CROSSLINKED CURED RESIN LAYER THEREOF

BACKGROUND OF THE INVENTION

1. Field of the Invention

The present invention relates to a keypad for use in cellular phones, personal digital assistants, remote controls for various household electrical appliances, car remote controls, and a variety of keyboards, and also to a recycling technique thereof.

2. Description of the Related Art

Several types of cover members for push button switches are used for cellular phones, various remote controls, etc. One type of cover member is a keypad that is fabricated by integrally forming a key top portion that is the main body of the keypad and is capable of being pressed, and a base portion that elastically supports the key top portion so that the key top portion is movable in the direction that it is pressed. In this example, both portions are made of the same rubbery elastic body. Another type of cover member is a keypad that is produced by causing the key top portion of a resin key to adhere to the base portion of a rubbery elastic body. Still another type of cover member is a keypad that is formed by adhering the key top portion of a resin key to a resin film base portion. Of these, the keypad that is fabricated by integrally forming the key top portion and the base portion by use of a rubbery elastic body includes few composition materials and is economically produced, and thus the demand for use of the type is great, particularly in terms of easy assembling and achievement in thinning, in applications to personal digital assistants, cellular phones, remote controls, and keypads for desk-top calculators. Silicone rubber is primarily utilized as the materials for the keypad obtained by integrally connecting the key top portion and the base portion because of its desirable properties of cold resistance, heat resistance, weather resistance, precision moldability and electric insulation.

However, while silicone rubber has desirable properties, such as weather resistance, it cannot readily be recycled because it is a cross-linked polymer. The preservation of the global environment and the efficient utilization of resources have recently become increasingly valued, and so the difficulty in recycling does not match the needs of the time and presents an important, urgent, still-unsolved social issue.

SUMMARY OF THE INVENTION

In view of the foregoing, it is therefore an object of the present invention to provide a readily recyclable keypad and a recycling technique thereof.

Further, in order to accomplish the above object, a keypad having a keypad main body that is composed of a thermoplastic elastomer and a cross-linked cured resin layer formed thereon that is composed of a cross-linked cured resin and is separable from the aforementioned keypad main body by swelling with a predetermined solvent is provided.

In addition, in order to accomplish the above object, a method of separating the aforementioned keypad main body from the aforementioned cross-linked cured resin layer by swelling the cross-linked cured resin layer with a solvent.

The above-mentioned keypad and the above-mentioned separation method, first of all, are characterized by formation of the keypad main body by use of a thermoplastic elastomer. That is, a thermoplastic elastomer that is not a cross-linked polymer, such as silicone rubber, is very easily re-molded due to melting by heating, and thus is a suitable raw material that can be recycled. Furthermore, a cross-linked cured resin layer formed on this keypad main body protects, for example, a display layer of letters, symbols, etc. produced by coating of ink and the outer surface of the keypad main body exposed to the exterior, which are placed on the keypad main body, from abrasion, flaws, stains, cracks, and the like, and therefore the layer is necessary for quality assurance of products. Additionally, this cross-linked cured resin layer is formed using a cross-linked cured resin that is capable of being separated from the aforementioned keypad main body by swelling with a predetermined solvent, and so an easy operation of swelling with the solvent readily permits the separation from the keypad main body. While a keypad of the present invention uses as a keypad main body a thermoplastic elastomer excellent in re-moldability, it is readily separated from a cross-linked cured resin layer; as a result, they can be recycled individually.

As used herein, "swelling" refers to a state of the cross-linked cured resin layer that allows the cross-linked cured resin layer and the keypad main body to readily separate from each other by at least any one of manual means, mechanical means, and means for letting them stand. After the application of stress to the adhesion interface, the stress caused by the increased volume of the cross-linked curing resin layer having absorbed the aforementioned solvent. In addition, the cross-linked cured resin layer and the keypad main body may separate by "swelling" because the adhesion interface is stressed as the result of an increased volume of the cross-linked cured resin by swelling. The cross-linked cured resin layer and the keypad main body may also separate because the intermolecular bonding and hydrogen bonding, which make up the adhesive force break down by the penetration of solvent into the interface.

Separation of a keypad main body and the cross-linked cured resin layer by means of a predetermined solvent as discussed above may also be readily performed on a keypad having a display layer prepared by applying a predetermined ink and hardening. Here, a display layer prepared by applying a predetermined ink and hardening may be a display layer produced by applying an ink in the shapes of characters, or the like and hardening, or may be a display layer produced by applying an ink in die-cut shapes of characters, or the like and hardening. When a display layer is soluble in a solvent for swelling the cross-linked cured resin layer, the display layer can be treated along with the solvent. Swelling of a display layer makes the layer easily separated from the other layers and is preferable.

In addition, the separation of a keypad main body and the cross-linked cured resin layer by means of a predetermined solvent is assessed as attainable when the cross-linked cured resin layer shows a weight per cent increase of 2 wt % or greater as an index due to swelling with the solvent. Swelling of the cross-linkage curing resin layer to an extent of a weight percent increase of 2 wt % or greater applies a stress to the adhesion interface with the keypad main body on account of volume increase, thereby allowing the layer to readily separate from the keypad main body. This brings about an easy separation of the cross-linked cured resin layer and the keypad main body, which in turn enables the separate, easy recycling of the cross-linked cured resin layer and the keypad main body.

The aforementioned cross-linked cured resin layer in the aforementioned keypad is swellable with water or an alcohol-based organic solvent having less than 10 carbon atoms. In this way, use of water or an alcohol-based organic solvent having less than 10 carbon atoms separates a cross-linked cured resin layer and the keypad main body without dissolving the keypad main body, thereby facilitating reuse of the keypad, and recovery and treatment of the solvent.

Furthermore, in the present invention, the aforementioned keypad main body is prepared by using at least one of the thermoplastic elastomers selected from the group consisting of styrene-based thermoplastic elastomers, ester-based thermoplastic elastomers, urethane-based thermoplastic elastomers, olefin-based thermoplastic elastomers, and vinyl-based thermoplastic elastomers. The cross-linked cured resin layer is produced by using at least one of the resins selected from the group consisting of urethane-based resins, epoxy-based resins, amino-based resins, acryl-based resins, cross-linking cyanoacrylate-based resins, polyester-based resins, alkyd-based resins, and melamine-based resins.

As a result, inasmuch as a keypad main body is prepared by using at least one of the thermoplastic elastomers selected from the group consisting of styrene-based thermoplastic elastomers, ester-based thermoplastic elastomers, urethane-based thermoplastic elastomers, olefin-based thermoplastic elastomers, and vinyl-based thermoplastic elastomers; and inasmuch as a cross-linkage curing resin layer is produced by using at least one of the resins selected from the group consisting of urethane-based resins, epoxy-based resins, amino-based resins, acryl-based resins, cross-linking cyanoacrylate-based resins, polyester-based resins, alkyd-based resins, and melamine-based resins, a keypad unit provides excellent design variations, high productivity and high workability as well. In addition, the aforementioned cross-linked cured resin layer and the keypad main body are readily separable by means of a solvent, thereby facilitating recycling.

The contents of the present invention are by no means limited to the above descriptions. The objects, advantages, characteristics and applications of the present invention will become more fully understood from the discussions below with reference to the accompanying drawings. In addition, it should be noted that various modifications and alterations without departing from the spirit and scope of the present invention all are included within the present invention.

DETAILED DESCRIPTION OF THE EXAMPLES

A keypad and a method of separating a cross-linked cured resin layer from the keypad for recycling in the present invention will be described.

Figure 1:
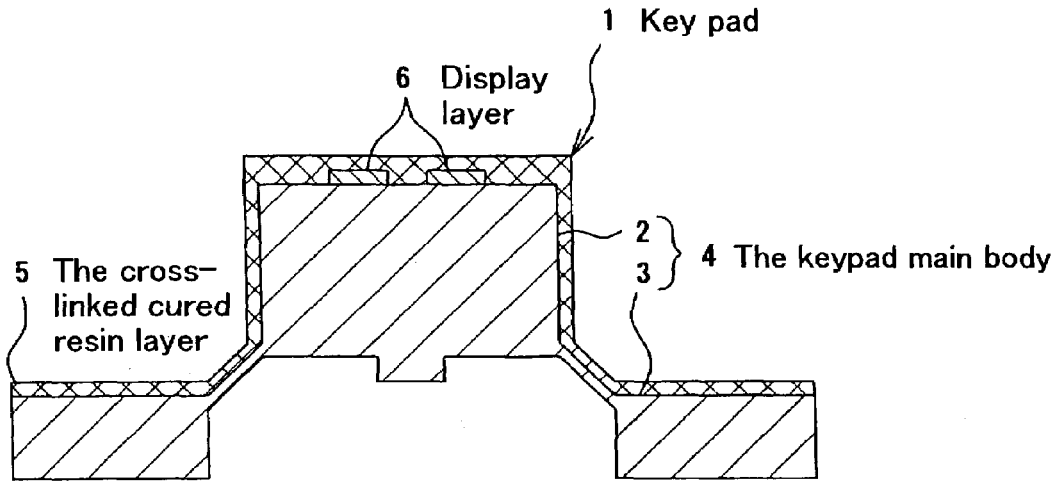
FIG. 1 is a longitudinal sectional view of a keypad in accordance with an embodiment of the present invention.
Figure 2:
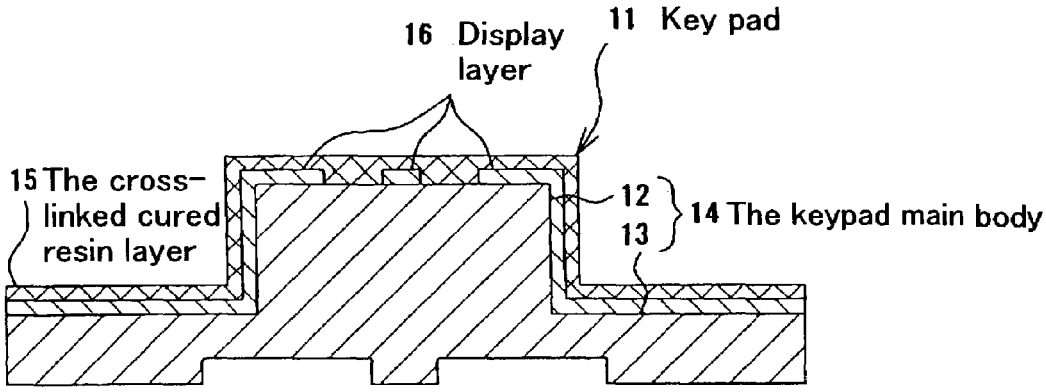
FIG. 2 is a longitudinal sectional view of a keypad in accordance with another embodiment of the present invention.

FIGS. 1 and 2 illustrate keypads of the present invention. A keypad 1 shown in FIG. 1 was prepared by forming a cross-linked cured resin layer 5 on the surface of a keypad main body 4, whereby the keypad main body 4 was made by connecting a key top portion 2 and a base portion 3 through the use of a skirt portion 7, taking into account the necessity of recycling and abrasion resistance desired for the key top portion 2. In addition, a keypad 11 illustrated in FIG. 2 was produced by forming a cross-linked cured resin layer 15 on the surface of a keypad main body 14 fabricated by connecting a key top portion 12 and a base portion 13 without using a skirt portion. In general, it is difficult to form the keypad main body 4 having a thin portion like a skirt portion because it is difficult to mold when, for example, the raw material for the keypad main body 4 is a thermoplastic elastomer, and the keypad main body 14 shown in FIG. 2 is rather good in yield and is efficient for mass production. The keypad 1 shown in FIG. 1 will be described hereinafter and for the keypad 11 illustrated in FIG. 2 the ways different from those of the keypad 1 only will be described, the descriptions of the same points being omitted.

1. Description of Keypad Main Body

A material used for the keypad main body 4 is a thermoplastic elastomer. Examples of thermoplastic elastomers include styrene based thermoplastic elastomers, ester based thermoplastic elastomers, urethane based thermoplastic elastomers, acryl based thermoplastic elastomers, olefin based thermoplastic elastomers, and vinyl based thermoplastic elastomers. These materials can be used as a single material, a blend material or an alloy material, depending on applications thereof. In addition, a thermoplastic elastomer may contain a variety of additives, etc. that are mixed in the step of processing into the keypad main body 4, besides additives that are mixed in the step of producing the thermoplastic elastomer.

When a transparent thermoplastic elastomer is used, light can be illuminated from the backside of the keypad 1 and passed through the keypad 1 to hit a display layer 6 such as a design formed in the key top portion 2. A transparent thermoplastic elastomer may only allow light in the range of ultraviolet light to visible light (light of wavelengths of 200 nm to 700 nm) to pass through. Examples of such thermoplastic elastomers include styrene, ester, urethane, and acryl based thermoplastic elastomers.

When the raw material for keypad main body 4 is a thermoplastic elastomer, the keypad main body 4 (as illustrated in FIG. 1) may be produced by injection molding, compression molding, transfer molding, etc. the heat-melted raw material into a mold having the desired keypad main body 4 shape and then solidifying the material.

2. Description of Display Layer

As shown in FIG. 1, the keypad 1 may have the display layer 6 formed in the shape of characters (e.g., letters, symbols, numbers, designs, etc.) on the key top portion 2 thereof, or as illustrated in FIG. 2, may have the display layer 16 formed in die-cut shapes of characters (e.g., letters, symbols, numbers, designs, etc.). A method of forming these letters, symbols, designs, etc. is not particularly limited, and such methods may also include a screen printing process, a pad printing process, a transfer printing process, a laser processing method, a vapor deposition, an inlaying process and a marking process. For example, the display layers 6 and 16 may be applied onto the keypad main body surface using an ink or paint. In another example, the shapes of letters, symbols, etc. may be hollowed by means of laser, etc. to form the display layer 16 after placing a layer as a light-shielding portion (light-shielding layer) on the keypad main body 14 of a transparent material, so that letters, symbols, etc. are formed, or letters, symbols, etc. are formed in a hollow letter fashion.

Inks, paints, etc. for use in forming the display layer 6 are not limited, and when productivity is considered, use of inks or paints of solvent volatile types can form the display layer 6 in a short time and thus is preferable. However, they can be selected, as appropriate, depending on the kinds of thermoplastic elastomers used for the keypad main body 4. For example, when the keypad main body 4 is made of a styrene-based thermoplastic elastomer, a chlorinated PP-based ink, non-chlorinated PP-based ink, styrene-based ink or urethane-based ink is preferable. For an ester-based thermoplastic elastomer, a single ink or a blend ink of urethane-based inks, polyester-based inks, vinyl-based inks, etc. is preferable. In the case of an olefin-based thermoplastic elastomer, a single ink or a blend ink of chlorinated polypropylene (PP)-based inks, non-chlorinated PP-based inks and vinyl-based inks is preferable. When a urethane-based thermoplastic elastomer is used, a single ink or a blend ink, e.g. a polyester/vinyl chloride-based ink, of urethane-based inks, polyester-based inks and vinyl-based inks is preferable. For an acryl-based thermoplastic elastomer, a single ink or a blend ink of acryl-based inks, vinyl-based inks, urethane-based inks, etc. is preferable. In addition, a resin soluble in a solvent that swells the cross-linked cured resin layer 5 is preferable so that the resin is recyclable by recovery along with the solvent when the swelling with the solvent is performed to separate the cross-linked cured resin layer 5 and the keypad main body 4. Moreover, a resin that may be swelled by a solvent is preferably used for the cross-linked cured resin layer 5 so that the resin is readily separable from the keypad main body 4.

When the display layer 16 is obtained by removing a predetermined portion of a light-shielding layer after the light-shielding layer is formed on the keypad main body 14, a cross-linked cured resin that may be swelled by a solvent similar to a raw material for a cross-linked cured resin layer discussed herein below is also usable as a raw material for the display layer 16. In this case, the swelling of, for example, the cross-linked cured resin layer 15 with a predetermined solvent-enables the separation from the keypad main body 14, which is composed of a thermoplastic elastomer, and is preferable for recycling of the keypad main body 14.

3. Description of Cross-linkage Curing Resin Layer

The keypad 1 is provided with the cross-linked cured resin layer 5 on the surface thereof. The cross-linked cured resin layer 5 is placed on the keypad main body 4, which protects the outer surface of the keypad main body 4 exposed to the exterior, including, for example, the display layer 6 of letters, symbols, etc. produced by coating of ink, and the uneven faces of the keypad main body 4 patterning the letters, symbols, etc. against abrasion, flaws, stains, cracks, and the like. The cross-linked cured resin layer 5 may also improve the feel of operation of the keypad 1, and therefore the layer is preferable for quality assurance of products. As such, a readily recyclable thermoplastic elastomer can be utilized for the keypad 1. In particular, when the opaque keypad main body 4 has the display layer 6 disposed on the key top portion 2, or when letters, symbols, etc. formed in the display layer 6 such that it protrudes out of the surface of the keypad 1, the cross-linked cured resin layer 5 is preferably used. Use of a resin that may be swelled by a solvent for the cross-linked cured resin layer 5 can readily separate the cross-linked cured resin layer 5 from the keypad 1 using the solvent, and thus makes recycling of high efficiency possible. A cross-linked cured resin is preferably used for the cross-linked cured resin layer 5 because it is preferable that the layer is subjected to a cross-linking reaction to form a three-dimensional network structure of cross-linked polymer. A typical push button switch is used under a variety of conditions and so an organic solvent comes in contact with the key top portion 2 in some cases. As such, a thermoplastic resin may dissolve in an organic solvent, and thus is not preferable. On the other hand, the cross-linked cured resin used for the cross-linked cured resin layer 5 has a three-dimensional network structure formed by cross-linking, and therefore maybe swelled with an organic solvent without dissolving the layer.

The cross-linked cured resin layer 5 is swelled by using a solvent and is thought to preferably cause a weight percent increase of 2 wt % or greater. The weight percent increase of 2 wt % or greater by swelling is an index of the extent of "swelling" of the separation capability empirically obtained according to Examples of the present invention discussed herein below. Because a variety of materials are selectively usable for each of the cross-linked cured resin layer 5 and the keypad, there can be an adhesive that exhibits "swelling" of separation capability depending on the combination even if the weight increase is less than 2 wt %. In other words, "swelling" herein refers to a state of the cross-linked cured resin layer 5 that allows the cross-linkage curing resin layer 5 and the keypad main body 4 to readily separate from each other by at least any one of manual means, mechanical means and means for letting them stand, after the application of stress to the adhesion interface, whereby the stress is caused by an increased volume of the cross-linked cured resin layer 5 having absorbed the organic solvent.

The cross-linked cured resin layer 5 and the keypad main body 4 may separate when the cross-linked cured resin layer 5 is swelled with a solvent because the adhesion interface is stressed as the result of an increased volume of the cross-linked cured resin by swelling. The cross-linked cured resin layer 5 and the keypad main body 4 may also separate because the intermolecular bonding and hydrogen bonding that make up the adhesive force break down by the penetration of solvent into the interface.

The curing reaction of a resin to form a cross-linked cured resin layer 5 is not limited, and applicable reactions including oxidation drying, bake drying, and room-temperature drying and/or heating reaction of two-component paints may be used. In addition, when the resin layer 5 is cured by bake drying, a mixed approach for a self-curing type and a reactive resin may be used as appropriate. Usable resins for the cross-linked cured resin layer 5 include, for example, at least one resin selected from the group consisting of a urethane-based resin, an epoxy-based resin, an amino-based resin, an acryl-based resin, a cross-linking cyanoacrylate-based resin, a polyester-based resin, an alkyl-based resin and a melamine-based resin. A urethane-based resin of urethane bonding is preferable when desiring properties of abrasion resistance, durability, hardness, etc.

A urethane-based resin is a reaction product of a polyol compound and an isocyanate compound. Such polyol compounds include at least one kind of compound selected from the group consisting of polyether polyols, polyester polyols, urethane modified polyols, acryl polyols, polybutadiene-based polyols, polyisoprene-based polyols, polyolefin-based polyols, polycarbonate-based polyols, saponified ethylene vinyl acetate copolymers, phosphorus-bearing polyols, silicon-bearing polyols, halogen-bearing polyols, polyols for flame retardancy, etc. Isocyanate compounds include at least one kind of compound selected from compounds such as xylylene diisocyanate (XDI), tolylene diisocyanate (TDI), tolidine diisocyanate (TODI), diphenylmethane diisocyanate (MDI), 3,3'-dimethyl-4,4'-diphenylmethane diisocyanate, p-phenylene diisocyanate, triphenylmethane triisocyanate, 1,3,6-hexamethylene triisocyanate, hexamethylene diisocyanate (HDI), isophorone diisocyanate (IPDI), lysine diisocyanate (LDI), naphthylene diisocyanate (NDI), methylcyclohexylene-2,4(2,6)-diisocyanate ($H_6XDI$), 1,3 (4)-(diisocyanatomel) cyclohexane ($H_{12}MDI$), lysine diisocyanate methylester (LDIM), trimethylhexamethylene diisocyanate (TMDI), dimer acid isocyanate (DDI), HMDI-biuret, trimethylolpropane adducts, and diethylfumarate diisocyanate (FDI), oligomers of adduct types, polymers, copolymers, biuret types, trimer types, block types, urethane prepolymers, etc.

Additionally, the cross-linked cured resin layer 5 may contain, as appropriate, a plasticizer, a reaction catalyst, a coupling agent, a coloring agent, a filler, a flatting agent, a precipitation inhibitor, a thixotropy agent, an antioxidant, an ultraviolet absorber, an anti-hydrolyzing agent, an antifoaming agent, etc. Furthermore, the color tone and presence or absence of luster of the cross-linked cured resin layer 5 are not limited, but when the keypad 1 is illuminated and letters, symbols, etc. of the key top surface are displayed, the cross-linked cured resin layer 5 is preferably transparent. In addition, the resin layer 5 preferably does not cover the entire outer top face of the keypad main body 4, but may be made to cover only the display layer 6.

Methods of forming the cross-linked cured resin layer 5 include the screen printing method, dispenser method, potting method, pad printing method, spray method, and transfer method, as well as a variety of methods, which involve placing the cross-linked cured resin layer 5 on the key top portion 2 of the keypad 1 and then curing it. A method of curing the cross-linked cured resin layer 5 is selected according to the kind of resin used in the cross-linked cured resin layer 5. Pressurizing, heating, or moistening can make the layer adhered thereto to be cured. For example, a process of forming the cross-linked cured resin layer 5 using a urethane-based resin includes mixing a blend of a predetermined polyol compound and an isocyanate compound as well as a urethane-based resin paint containing as appropriate a formulation ingredient, such as a coloring agent with, as appropriate, any of an aromatic hydrocarbon-based organic solvent, aliphatic hydrocarbon-based organic solvent, ketone-based organic solvent, ester-based organic solvent, etc., applying the resulting blend onto the key top surface by pad printing, and subsequently curing it to obtain the cross-linked cured resin layer 5.

When the adhesion of the cross-linked cured resin layer 5 to the keypad main body 4 is insufficient, the surface is modified by means of at least any one of a short-wavelength ultraviolet ray irradiation treatment, a corona discharge treatment, a flame treatment, a plasma treatment, and a primer treatment using chlorinated PP, etc., which allows the cross-linkage curing resin layer 5 to strongly adhere. Also, the surfaces of keypad main bodies 4 may be subjected to surface treatment using a variety of coupling agents, such as silane-based, titanium-based, and aluminum-based coupling agents, and primers. In addition, the short-wavelength ultraviolet ray irradiation treatment performs surface modification by irradiating the surface of the keypad main body 4 with short-wavelength ultraviolet rays at a constant illuminance in a constant accumulated amount of light. For instance, radioactive rays of the wavelengths of 184.9 nm and 253.7 nm are irradiated from a mercury lamp with mercury sealed at a pressure of about $10^{-1}$ mm Hg in the presence of oxygen to generate ozone, which is made to oxidize the surface of a body to be treated to form active groups such as carboxyl groups, leading to the improvement of the adhesion properties and affinities of inks, paints, or the like. Corona discharge treatment involves applying a high voltage between electrodes in the atmosphere to produce electrical discharges by causing dielectric breakdown, and allowing a body to be treated to pass therethrough to thereby oxidize polymers on the surface layers, thereby introducing active groups to the surface. Flame treatment includes passing a body to be treated through strong oxidizing flame to oxidize polymers on the surface layers, as in corona treatment, thereby providing the effect of introducing active groups to the surface. Plasma treatment comprises causing a glow discharge in an inert gas, oxygen, a halogen gas, or the like of a low pressure to ionize gas molecules, which leads to the generation of plasma, and activating the surface of the keypad main body 4 utilizing the chemical activity of the plasma. In addition, the cleaning of the surface layer of the keypad main body 4 by using at least one kind of a surfactant liquid, an aqueous solution thereof, a solvent, etc. is also effective in improving adhesion properties. Usable examples include a method that involve swiping out the surface of the keypad main body 4 with a cotton cloth dampened with a solvent.

The film thickness of the cross-linkage curing resin layer 5 is preferably from 5 μm to 100 μm, more preferably 10 μm to 60 μm. A film thickness of less than 5 μm is insufficient in abrasion resistance, and concavities like nail scratches, etc. tend to be created when the thickness exceeds 100 μm.

In addition, the shape of the key top portion 2 of the keypad 1 is made flat and may also be made thinned or hollowed for reducing the weight or improving moldability.

Thus far, the keypad main body 4, the cross-linked cured resin layer 5 and the display layer 6 have been discussed. Usable materials for the keypad main body 4 include at least one of the thermoplastic elastomers selected from styrene-based thermoplastic elastomers, ester-based thermoplastic elastomers, urethane-based thermoplastic elastomers, acryl-based thermoplastic elastomers, olefin-based thermoplastic elastomers, and vinyl-based thermoplastic elastomers. Usable materials for the cross-linked cured resin layer 5 include at least one of the resins selected from the group consisting of urethane-based resins, epoxy-based resins, amino-based resins, acryl-based resins, cross-linking cyanoacrylate-based resins, polyester-based resins, alkyd-based resins, and melamine-based resins. These compositions preferably lead to high design variations and free selection between an illumination mode and a non-illumination mode with high productivity and workability, as well as to easy separation of the cross-linked cured resin layer 5 from the keypad 1 (separation of the keypad main body 4 and the cross-linked cured resin layer 5) and easy recycling of the members separated.

4. Method of Separating Cross-linked Cured Resin Layer and Keypad Main Body

According to the present invention, a keypad main body 4 is made of a thermoplastic elastomer and the cross-linked cured resin layer 5 is made of a resin that is cured to form a cross-linked cured resin, and thus a keypad is mostly produced from a thermoplastic substance. Therefore, when the substance is utilized in a material for a product that permits the inclusion of a few amount of impurities, use of an organic solvent that dissolves this thermoplastic substance or heat-melting of this substance having the cross-linked cured resin layer 5 attached thereto is thought to directly lead to recycling of the substance. However, the recycling of a thermoplastic substance with the cross-linked cured resin layer 5 attached thereto lowers the quality of the recycled article due to the inclusion of the resin as an impurity. Hence, it is preferable to separate the cross-linked cured resin layer 5 from the keypad 1 and recycle them individually.

To separate the cross-linked cured resin layer 5 and the keypad main body 4 from the keypad 1, a solvent is used to swell the cross-linked cured resin layer 5. A method of swelling the cross-linkage curing resin layer 5 is not particularly limited and usable methods include a process of immersing the keypad 1 in a solvent, a process of spraying a solvent on the cross-linked cured resin layer 5, and a process of placing the keypad 1 in an atmosphere of solvent. When swelling of the cross-linked cured resin layer 5 does not lead to a natural separation of the cross-linked cured resin layer 5 from the keypad main body 4, a method that provides supersonic vibration or a jet bubble water stream in addition to an agitation method may be used to separate them.

Solvents capable of swelling cross-linked cured resins may include, for example, water or an inorganic solvent and organic solvents, such as, hydrocarbon-based, ketone-based, ester-based, ether-based, chlorine-based, and alcohol-based solvents. Such hydrocarbon-based solvents include hexane, heptane, octane, cyclohexane, benzene, toluene, xylene, and the like. Ketone-based solvents include dimethyl ketone, diethyl ketone, methylethyl ketone, cyclohexanone, and the like. Ester-based solvents include methyl acetate, ethyl acetate, propyl acetate, and the like. Ether-based solvents include ethylmethyl ether, diethyl ether, and the like. Chlorine-based solvents include trichloroethane, tetrachloroethane, trichloroethylene, and the like. Alcohol-based solvents include methanol, ethanol, 1-propanol, 2-propanol, 1-methylpropanol, 2-methylpropanol, 1-butanol, 2-butanol, 2-methylbutanol, and the like. However, solvents other than these organic solvents, which may be used to swell the cross-linked cured resin layer 5, are usable as well and preferably increase the weight percent of a cross-linked cured resin by 2 wt % or greater. It should be noted that these solvents can be used singly or in a mixture. In addition, solvents that contain additives according to various applications, impurities, etc. may also be used.

Use of an alcohol-based organic solvent having less than 10 carbon atoms leads to an easy separation of the solvent and a thermoplastic elastomer without dissolving the keypad main body 4 made of a thermoplastic elastomer, thereby permitting the obtainment of a high-quality recycled article of the thermoplastic elastomer. A long-chain alcohol having 10 carbon atoms or greater does not sufficiently swell the cross-linked cured resin layer 5 and is not preferably used.

When a urethane-based resin is used for the cross-linked cured resin layer 5, a method that involves swelling the cross-linked cured resin layer 5 by using water as a solvent (e.g., by circulating warm water or hot water) is preferable from the viewpoint of operation safety.

The present invention will hereinafter be described in detail by means of examples and comparative examples; however, the invention is not limited to the examples described below.

EXAMPLE 1

The display layer 6 was formed by means of screen printing using a vinyl chloride based ink ("VIC," available from Seiko Advance Ltd.; room temperature drying type) on the top face of the key top portion 2 of the keypad main body 4 prepared using a styrene-based thermoplastic elastomer ("SEPTON CJ002," available from Kuraray Co., Ltd.). Furthermore, a blend prepared using urethane-modified polyols as a polyol compound and $H_6$XDI as an isocyanate compound was set at NCO/OH=1.5 to 2.0 and to this were added a plasticizer, a flatting agent, an ultraviolet absorber, an antioxidant, an antifoaming agent, and a catalyst. The resulting mixture was viscosity-adjusted with a solvent for coating to yield a blend, which was applied on the surface of the keypad main body 4 by means of the spray method. Thereafter, the coat was heated at 80° C. for 30 minutes to form the cross-linked cured resin layer 5 of an urethane-based resin. In this way, the recyclable keypad 1 with the keypad main body 4 having the cross-linked cured resin layer 5 coated on the surface thereof was obtained. The keypad main body 4 and the cross-linked cured resin layer 5 were readily separated by immersing the obtained keypad 1 in hot water at 100° C. for 2 hours, and then agitating the hot water.

EXAMPLE 2

The display layer 6 was formed by means of screen printing using a vinyl chloride based ink ("VIC," available from Seiko Advance Ltd.; room temperature drying type) on the top face of the key top portion 2 of the keypad main body 4 prepared using a styrene-based thermoplastic elastomer (a blend with a weight ratio of styrene to epoxy modified styrene being 7:3) and the surface of the keypad main body 4 was treated by corona modification. Furthermore, a blend prepared using polyester-modified polyols as a polyol compound and an HDI biuret type as an isocyanate compound was set at NCO/OH=1.0 to 1.2 and to this were added a plasticizer, a flatting agent, an ultraviolet absorber, an antioxidant, an antifoaming agent, and a catalyst. The resulting mixture was viscosity-adjusted with a solvent for coating to yield a blend, which was applied on the surface of the keypad main body 4 by means of the spray method. Thereafter, the coat was heated at 80° C. for 30 minutes to form the cross-linked cured resin layer 5 of a urethane-based resin. In this way, the recyclable keypad 1 with the keypad main body 4 having the cross-linked cured resin layer 5 coated on the surface thereof was obtained. The keypad main body 4 and the cross-linked cured resin layer 5 were readily separated by boiling the obtained keypad 1 in boiling water.

EXAMPLE 3

The display layer 6 was formed by means of screen printing using a PP based ink ("SPP," available from Seiko Advance Ltd.; room temperature drying type) on the top face of the key top portion 2 of the keypad main body 4 prepared using a olefin-based thermoplastic elastomer ("Santoprene," available from Advanced Elastomer Systems Japan Ltd.) and the surface of the keypad main body 4 was treated by corona modification. Furthermore, a blend prepared using polyester-modified polyols as a polyol compound and an IPDI as an isocyanate compound was set at NCO/OH=1.2 to 1.5 and to this were added a plasticizer, a flatting agent, an ultraviolet absorber, an antioxidant, an antifoaming agent, and a catalyst. The resulting mixture was viscosity-adjusted with a solvent for coating to yield a blend, which was applied on the surface of the keypad main body 4 by means of the PAD printing method. Thereafter, the coat was heated at 80° C. for 30 minutes to form the cross-linked cured resin layer 5 of aurethane-based resin. In this way, there cyclable keypad 1 with the keypad main body 4 having the cross-linked cured resin layer 5 coated on the surface thereof was obtained. The keypad main body 4 and the cross-linkage curing resin layer 5 were readily separated by immersing the obtained keypad 1 in warm water at 60° C. for 2 hours, and then agitating the hot water.

EXAMPLE 4

The display layer 6 was formed by means of PAD printing using a polyester-based ink ("SG720" available from Seiko Advance Ltd.) on the top face of the key top portion 2 of the keypad main body 4 prepared using a ester based thermoplastic elastomer ("GRILUX E200LV," available from DAINIPPON INK AND CHEMICALS, INCORPORATED). Furthermore, a blend prepared using polyester-modified polyols as a polyol compound and an XDI as an isocyanate compound was set at NCO/OH=1.2 to 1.5 and to this were added a plasticizer, a flatting agent, an ultraviolet absorber, an antioxidant, an antifoaming agent, and a catalyst. The resulting mixture was viscosity-adjusted with a solvent for coating to yield a blend, which was applied on the surface of the keypad main body 4 by means of the PAD printing method. Thereafter, the coat was heated at 80° C. for 30 minutes to form the cross-linked cured resin layer 5 of a urethane-based resin. In this way, the recyclable keypad 1 with the keypad main body 4 having the cross-linked cured resin layer 5 coated on the surface thereof was obtained. The keypad main body 4 and the cross-linkage curing resin layer 5 were readily separated by immersing the obtained keypad 1 in ethanol for 2 hours, and then agitating the ethanol with ultrasonic waves.

EXAMPLE 5

The display layer 6 was formed by means of screen printing using an urethane-based ink ("SG410," available from Seiko Advance Ltd.) on the top face of the key top portion 2 of the keypad main body 4 prepared using an urethane-based thermoplastic elastomer ("RESAMINE P," available from Dainichiseika Color & Chemicals Mfg. Co., Ltd.) and the resultant was heated at 80° C. for 30 minutes to be cured. Furthermore, a blend prepared using urethane-modified polyols as a polyol compound and an $H_6$XDI as an isocyanate compound was set at NCO/OH=1.5 to 2.0 and to this were added a plasticizer, a flatting agent, an ultraviolet absorber, an antioxidant, an antifoaming agent, and a catalyst. The resulting mixture was viscosity-adjusted with a solvent for coating to yield a blend, which was applied on the surface of the keypad main body 4 by means of the spray method. Thereafter, the coat was heated at 80° C. for 30 minutes to form the cross-linked cured resin layer 5 of a urethane-based resin. In this way, the recyclable keypad 1 with the keypad main body 4 having the cross-linked cured resin layer 5 coated on the surface thereof was obtained. The keypad main body 4 and the cross-linked cured resin layer 5 were readily separated by immersing the obtained keypad 1 in methanol for 2 hours, and then agitating the methanol with ultrasonic waves.

EXAMPLE 6

The display layer 6 was formed by means of screen printing using an urethane-based ink ("SG410," available from Seiko Advance Ltd.) on the top face of the key top portion 2 of the keypad main body 4 prepared using an amide-based thermoplastic elastomer ("Diamde," available from DAICELHULS LTD.) and the resultant was heated at 80° C. for 30 minutes to be cured. Furthermore, a blend prepared using polyester-modified polyols as a polyol compound and IPDI as an isocyanate compound was set at NCO/OH=1.2 to 1.5 and to this were added a plasticizer, a flatting agent, an ultraviolet absorber, an antioxidant, an antifoaming agent, and a catalyst. The resulting mixture was viscosity-adjusted, which was applied on the surface of the keypad main body 4 by means of the spray method. Thereafter, the coat was heated at 80° C. for 30 minutes to form the cross-linked cured resin layer 5 of a urethane-based resin. In this way, the recyclable keypad 1 with the keypad main body 4 having the cross-linked cured resin layer 5 coated on the surface thereof was obtained. The keypad main body 4 and the cross-linked cured resin layer 5 were readily separated by immersing the obtained keypad 1 in methanol for 2 hours, and then agitating the methanol with ultrasonic waves.

EXAMPLE 7

The display layer 6 was formed by means of screen printing using a polyester-based ink ("SG720," available from Seiko Advance Ltd.) on the ceiling face of the key top portion 2 of the keypad main body 4 prepared using an ester-based thermoplastic elastomer ("GRILUX E200LV," available from DAINIPPON INK AND CHEMICALS, INCORPORATED). Furthermore, a blend prepared using polyester-modified polyols as a polyol compound and XDI as an isocyanate compound was set at NCO/OH=1.2 to 1.5 and to this were added a plasticizer, a flatting agent, an ultraviolet absorber, an antioxidant, an antifoaming agent, and a catalyst. The resulting mixture was viscosity-adjusted with a solvent for coating to yield a blend, which was applied on the surface of the keypad main body 4 by means of the PAD printing method. Thereafter, the coat was heated at 80° C. for 30 minutes to form the cross-linked cured resin layer 5 of an urethane-based resin. In this way, the recyclable keypad 1 with the keypad main body 4 having the cross-linked cured resin layer 5 coated on the surface thereof was obtained. The keypad main body 4 and the cross-linked cured resin layer 5 were readily separated by subjecting the obtained keypad 1 to a reflux of boiling water.

EXAMPLE 8

The surface of the key top portion 12 of the keypad main body 14 formed using a styrene-based thermoplastic elastomer ("Septon CJ002," available from Kuraray Co., Ltd.) was treated by corona modification, and then on the surface was applied an urethane-based ink ("SG410," available from Seiko Advance Ltd.). The coat was cured by heating at 80° C. for 30 minutes and then the resulting resin layer was removed using laser in a predetermined letter shape to form the display layer 16. Furthermore, a blend prepared using polyester-modified polyols as a polyol compound and XDI as an isocyanate compound was set at NCO/OH=1.2 to 1.5 and to this were added a plasticizer, a flatting agent, an ultraviolet absorber, an antioxidant, and an antifoaming agent. The resulting mixture was viscosity-adjusted with a solvent for coating to yield a blend, which was applied on the surface of the keypad main body 14 by means of the spray method. Thereafter, the coat was heated at 80° C. for 30 minutes to form the cross-linked cured resin layer 15 of an urethane-based resin. In this way, the recyclable keypad 11 with the keypad main body 14 having the cross-linked cured resin layer 15 coated on the surface thereof was obtained. The keypad 11 thus obtained was immersed in hot water at 100° C. for 2 hours, and then the agitation of the hot water permitted the keypad 11 to easily separate into the keypad main body 14 and the cross-linkage curing resin layer 15.

For the keypads 1 and 11 described in Examples 1 to 8, the display layers 6 and 16 each exhibit sufficient abrasion resistant properties and excellent appearances after repeated use. The manufacturing processes were also short as well.

COMPARATIVE EXAMPLE 1

The top face of the key top portion of a keypad main body formed using a styrene-based thermoplastic elastomer ("Septon CJ002," available from Kuraray Plastics Co., Ltd.) was treated by corona modification, and the display layer was formed by means of screen printing using an urethane-based ink ("SG410," available from Seiko Advance Ltd.), and then it was heat-cured at 80° C. for 30 minutes. Further, the surface was subjected to surface treatment via short-wavelength ultraviolet rays or corona modification and then a photoreaction curing acrylic resin ("HO2777U," available from Fujikura Kasei Co., Ltd.) was applied on the surface of the keypad main body. Then, the resulting coat was irradiated with ultraviolet rays with a main wavelength of 365 nm at an intensity of 600 mW/cm$^2$ for 10 seconds to form an ultraviolet cross-linkage curing resin layer. The keypad thus obtained was immersed in methanol for 2 hours, and then was agitated using ultrasonic waves. The keypad failed to separate the keypad main body and the cross-linked cured resin layer because the ultraviolet ray cured resin layer is a cross-linked polymer and methanol does not swell it. This keypad is also difficult to recycle.

Swelling Experiment

Additionally, cross-linked cured resins cured by reaction were subjected to the swelling experiment by means of immersion in solvents. The procedure of this experiment involves forming a cross-linked cured resin to become a cross-linked cured resin layer so as to have a predetermined surface area, immersing the resin in a solvent for a predetermined time period, and subsequently determining the increased ratio (percentage) of the resin weight. Resins and a solvent used are given below.

Sample A: Urethane-based resin used in Examples 1 and 5 Methanol

Sample B: Urethane-based resin used in Example 2 Methanol

Sample C: Urethane-based resin used in Examples 4, 7, and 8 Methanol

Sample D: Urethane-based resin used in Examples 1 and 5 Boiling water of 100° C.

Sample E: Acrylic-based resin used in Comparative Example 1 Methanol

Figure 3:
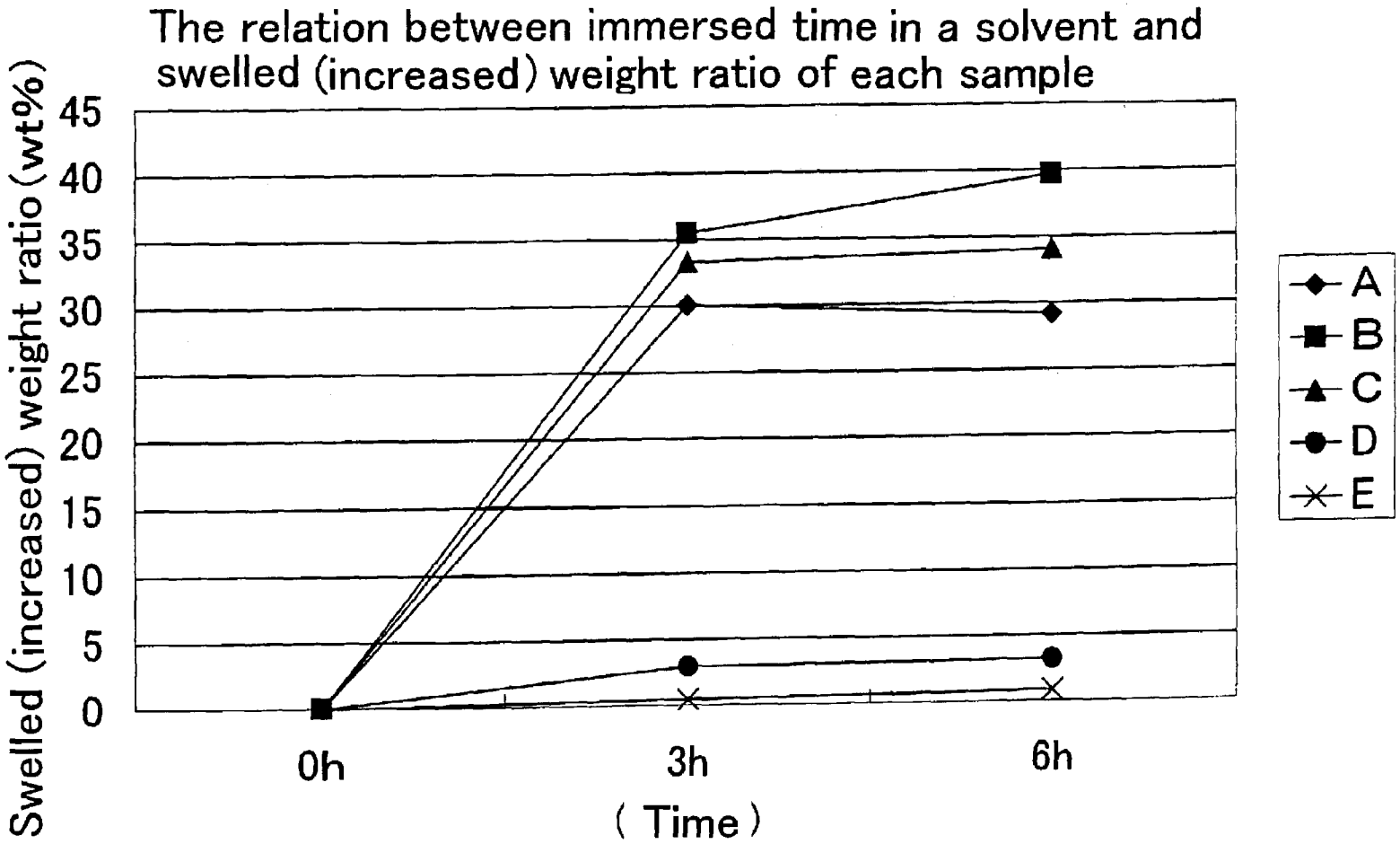
FIG. 3 is a graph illustrating an amount of swelled cross-linkage curing resin layer for use in the present invention.

In addition, FIG. 3 and Table 1 below show the results of this swelling experiment.

TABLE 1

| Kind of sample | Increased (swelled) weight ratio (wt %) of each sample from initial weight — Test duration 0 h | 3 h | 6 h |
|---|---|---|---|
| Sample A | 0 | 30.07 | 29.18 |
| Sample B | 0 | 35.52 | 39.68 |
| Sample C | 0 | 33.31 | 34.10 |
| Sample D | 0 | 2.95 | 3.22 |
| Sample E | 0 | 0.43 | 0.85 |

Examples and Comparative Example described above as well as the swelling experiment show that in the keypads 1 and 11 of the present invention having used cross-linked cured resins that swell, the cross-linked cured resin layers 5 and 15 and the keypad main bodies 4 and 14 are readily separated from each other, while in the keypad of Comparative Example 1 having used a cross-linked cured resin that does not swell the resin layer and the keypad main body are difficult to separate from each other.

INDUSTRIAL APPLICABILITY

According to the method of separating the keypad, the keypad main body and the cross-linked cured resin layer of the present invention, the keypad main body is made of a thermoplastic elastomer and has a cross-linked cured resin layer placed thereon, which eliminates the defects of the display layer placed on the thermoplastic elastomer surface exhibiting low abrasion resistant properties and the display layer readily disappearing and which not only renders the display layer to hardly disappear even if the key is repeatedly used, but also allows the cross-linked cured resin layer to readily separate from the keypad main body when the resin layer is made swelled with a solvent, thereby making it possible to individually and readily recycle the cross-linked cured resin layer and the keypad main body of the thermoplastic elastomer and to obtain a recycled article of high quality.

In addition, a method of separating a keypad main body and the cross-linked cured resin layer of the present invention permits the separation of a keypad main body and the cross-linked cured resin layer by providing an organic solvent on the keypad and the removal of the cross-linked curing resin layer, thereby allowing recycling excellent in quality that leads to little mixing of impurities. In particular, use of water or an alcohol-based organic solvent having less than 10 carbon atoms enables the separation of a cross-linked cured resin layer and the keypad main body without dissolving them and separate recycling of them.

What is claimed is:

1. A method of separating a cross-linked cured resin layer from a keypad main body for use as a recyclable article, wherein the cross-linked cured resin layer is formed on a keypad main body of the keypad, the method comprising:

applying a solvent to at least the keypad;

swelling the cross-linked cured resin layer with the solvent; and removing the swollen cross-linked cured resin layer from the keypad main body, the removing providing a recyclable article of the cross-linked cured resin layer.

2. A method of separating a cross-linked curedresin layer from a keypad main body according to claim 1, wherein the keypad includes a display layer formed between the keypad main body and the cross-linked cured resin layer by applying an ink and curing.

3. A method of separating a cross-linked cured resin layer from a keypad main body according to claim 2, wherein the display layer is capable of being dissolved or swelled by the solvent.

4. A method of separating a cross-linked cured resin layer from a keypad main body according to claims 1 or 2, wherein the solvent causes the weight of the cross-linked cured resin layer to increase by 2 wt % or greater.

5. A method of separating a cross-linked cured resin layer from a keypad main body according to claim 1 or 2, wherein the solvent is water.

6. A method of separating a cross-linked cured resin layer from a keypad main body according to claims 1 or 2. wherein the solvent is an alcohol-based organic solvent having less than 10 carbon atoms.

7. A method of separating a cross-linked cured resin layer from a keypad main body according to claim 4, wherein the solvent is water.

8. A method of separating a cross-linked cured resin layer from a keypad main body according to claim 4, wherein the solvent is an alcohol-based organic solvent having less than 10 carbon atoms.

9. A method of separating a cross-linked cured resin layer from a keypad main body according to claim 1, wherein;

the keypad main body is constructed using at least one of the thermoplastic elastomers selected from the group consisting of styrene-based thermoplastic elastomers, ester-based thermoplastic elastoiners, urethane-based thermoplastic elastomers, acrylic-based thermoplastic elastomers, olefinbased thermoplastic elastonters, and vinyl-based thermoplastic elastomers;

the cross-linked cured resin layer is constructed using at least one of the cross-linked cured resins selected front the group consisting of urethane-based resins, epoxy-based resins, amino-based resins, acryl-based resins, cross-linking cyanoacrylatebased resins, polyester-based resins, alkyd-based resins; and the solvent is an alcohol-based organic solvent having less than 10 carbon atoms.

* * * * *